US006695364B2

(12) United States Patent
Bierlin

(10) Patent No.: US 6,695,364 B2
(45) Date of Patent: Feb. 24, 2004

(54) TAMPER PROOF PACKAGE LABEL AND CLOSURE CONSTRUCTION

(75) Inventor: Erick M. Bierlin, Cary, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/093,144

(22) Filed: Mar. 7, 2002

(65) Prior Publication Data

US 2003/0168868 A1 Sep. 11, 2003

(51) Int. Cl.[7] ..... B65D 63/00; B65D 33/16

(52) U.S. Cl. ..... 292/307 A; 292/307 R; 24/16 R; 24/16 PB; 24/30.5 R; 24/30.5 S; 24/30.5 P; 24/304

(58) Field of Search ..... 292/307 A, 307 R; 24/16 R, 16 PB, 30.5 R, 30.5 S, 30.5 P, 304

(56) References Cited

U.S. PATENT DOCUMENTS

| | | | | | |
|---|---|---|---|---|---|
| 58,894 | A | | 8/1866 | Brown | |
| 62,241 | A | | 2/1867 | Wells | |
| 96,459 | A | | 11/1869 | Meloy | |
| 113,834 | A | | 4/1871 | Balch et al. | |
| 182,771 | A | | 10/1876 | Palmberg | |
| 478,185 | A | * | 7/1892 | Barnum | 40/663 |
| 712,765 | A | | 11/1902 | Cole | |
| 1,069,512 | A | | 8/1913 | Adolphson | |
| 2,112,477 | A | * | 3/1938 | Brownfield | 383/71 |
| 2,246,229 | A | * | 6/1941 | Wohlmuth | 452/187 |
| 2,462,957 | A | | 3/1949 | Gunn | |
| 3,153,350 | A | | 10/1964 | Vosbikian | |
| 3,270,872 | A | * | 9/1966 | Paxton | 206/232 |
| 3,315,324 | A | * | 4/1967 | Ward | 24/30.5 P |
| 3,322,325 | A | * | 5/1967 | Bush | 383/71 |
| 3,362,411 | A | * | 1/1968 | Moller | 402/15 |
| 3,591,223 | A | | 7/1971 | Neto | |
| 3,757,936 | A | * | 9/1973 | Lindgren | 206/527 |
| 3,837,101 | A | * | 9/1974 | Young | 40/665 |
| 4,227,668 | A | * | 10/1980 | Ernst | 248/317 |
| 4,370,778 | A | | 2/1983 | Madson | |
| 4,379,372 | A | * | 4/1983 | Alexander et al. | 40/10 C |
| 4,379,536 | A | | 4/1983 | Mizuno et al. | |
| 4,509,231 | A | * | 4/1985 | Paxton | 24/30.5 R |
| 4,557,023 | A | | 12/1985 | Six et al. | |
| 4,700,432 | A | * | 10/1987 | Fennell | 24/16 R |
| 4,817,901 | A | | 4/1989 | Kuo | |
| 4,878,702 | A | | 11/1989 | Madsen et al. | |
| 5,086,543 | A | * | 2/1992 | Mitchell | 24/16 PB |
| 5,524,945 | A | * | 6/1996 | Georgopoulos et al. | 292/307 A |
| 5,533,767 | A | * | 7/1996 | Georgopoulos et al. | 292/320 |
| 5,544,391 | A | | 8/1996 | Hoffman | |
| 5,697,177 | A | * | 12/1997 | Ludlow et al. | 40/665 |
| 6,062,622 | A | * | 5/2000 | Susman et al. | 294/149 |

* cited by examiner

*Primary Examiner*—J. J. Swann
*Assistant Examiner*—Carlos Lugo
(74) *Attorney, Agent, or Firm*—Banner & Witcoff, Ltd.

(57) ABSTRACT

A tamper proof label and closure construction includes a coded label section with a passage for reclosing a bag and further includes a closure section which may be wrapped around gathered package material and sealed. Removal of the sealed closure section will indicate tampering or intentional opening of the closed, sealed bag.

15 Claims, 1 Drawing Sheet

FIG.1
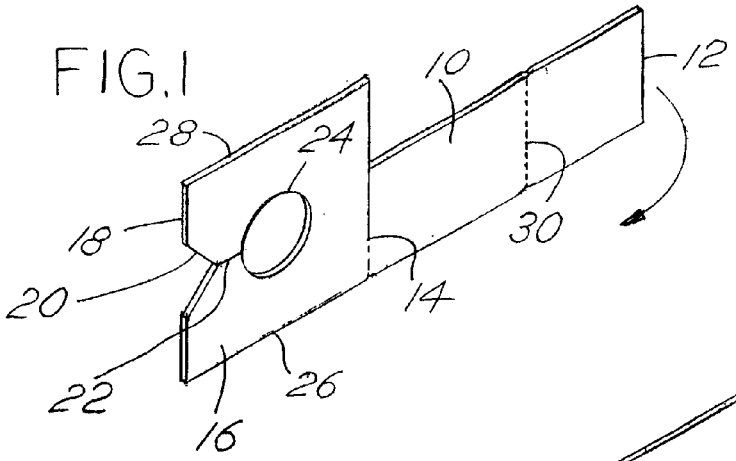
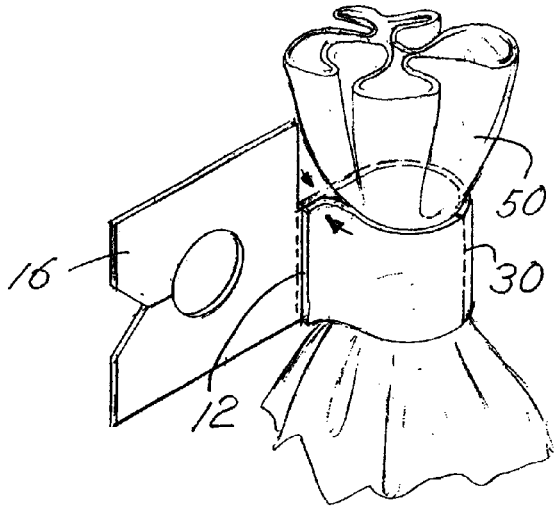
FIG.2
FIG.3
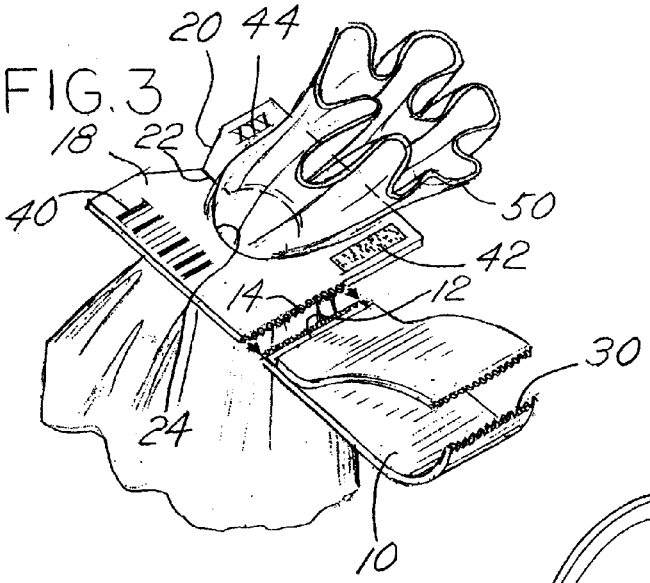
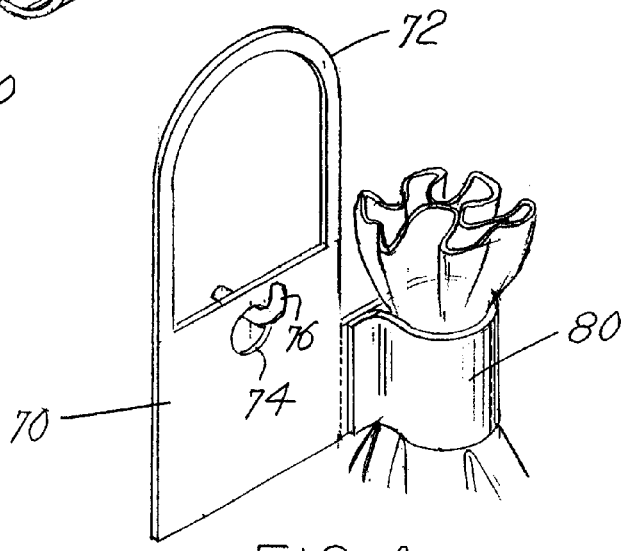
FIG.4

TAMPER PROOF PACKAGE LABEL AND CLOSURE CONSTRUCTION

BACKGROUND OF THE INVENTION

In a principal aspect, the present invention relates to a tamper proof package label and closure construction comprised of a plastic plate or tag capable of being heat sealed or ultrasonically sealed about gathered packaging material and further capable of providing label indicia coded to the product or features of the product in the package secure by the closure.

Many products, and in particular food products, are packaged in flexible bags or containers. Those containers are accessible through the open top of the flexible bag and the bag is typically maintained in a closed condition by means of a twist-tie or a plastic locking tag. Such means for closing or maintaining a package in a closed condition are useful. However, the bag may be easily opened and then closed without detection rendering the contents subject to tampering.

An alternative to utilizing such devices is to provide adhesive to close the bag or a tie having a locking feature. Examples of ties include devices such as shown in U.S. Pat. No. 712,765 and No. 5,544,391. Other options include the use of a clip mechanism. Examples of clip mechanisms are disclosed in U.S. Pat. No. 4,878,702 and No. 4,370,778.

Thus, there has remained a need for providing a simple, yet effective closure construction or assembly which provides tamper proof characteristics, that is, a closure construction wherein the opening of the closure mechanism is characterized by removal of the closure from the bag or container thereby indicating that the contents of the bag or container have been accessed. Further, it is desirable to provide a closure construction or assembly wherein the closure device itself may be reused to close the bag or container which has been purposely opened by the party possessing the bag and its contents. In other words, the concept of having a tamper proof construction is desired along with the concept of a construction which can be used over and over to close the bag.

Providing a closure mechanism which has such multiple uses and applications is deemed desirable. Additionally, it is desirable to provide a closure construction which may include indicia or information relating to the contents of the container or bag or in some manner, include coding information on the label construction. These desires, among others, inspired the development of the present invention.

SUMMARY OF THE INVENTION

Briefly, the present invention comprises a tamper proof package label and closure construction which is formed from an elongate flat plastic planar plate member divided generally into two sections. The first section comprises a bag closure section and is integral with the second section which comprises a label section. In the preferred embodiment, the sections are each generally rectangular and are integrally formed with a boundary defining the junction between the sections. The shape of the integral or connected sections should not be considered a limiting feature of the closure construction.

The bag closure section is designed to be wrapped around a gathered bag or container and folded over on itself to thereby clamp the gathered container packaging or material in a closed condition with the folded over closure section joined typically by means of ultrasonic welding, adhesive, or heat sealing. Other means of joinder, such as melt processing, may be utilized to join the elongated, folded over bag closure section. The bag closure section further preferably includes a fracture seam which serves to permit severance of the closure section thereby permitting tearing and removal of the closure construction from the bag or container to which it is attached.

The bag closure section is also attached to the label section along a boundary or a seam, which is also severable. Thus, the label section may be detached from the closure section.

The label section includes a face or area onto which printed indicia, color indicators, or other informational indicia may be printed or incorporated. The label section further includes a guide notch extending inwardly on a side thereof connected via a slit with a shaped passage or opening. In this manner, the label section comprises a plastic, locking tag inasmuch as it may be separated from the bag closure section and used to temporarily close gathered packaging material fitted through the slit and into the shaped passage. Additionally or alternatively, the label section may include a handle or an opening which enables the label section to be hung on a hook, for example.

Thus, it is an object of the invention to provide an improved tamper proof package label and closure construction comprised of a generally planar or flat plastic plate member divided into two integral, but separable sections; namely, a bag closure section and an integral label section.

It is a further object of the invention to provide a tamper proof closure construction which effectively seals and closes gathered packaging material and which may be removed therefrom along a fragible or fracture seam defined in the closure construction.

A further object of the invention is to provide a closure construction which is capable of incorporating indicia, color or other identifying information on a label section.

Another object of the invention is to provide a label section for a package closure construction wherein the label section is capable of multiple uses including use as an information carrying portion of the closure construction as well as a bag closure feature for temporarily closing a bag or gathered material once it has been opened.

A further object of the invention is to provide an inexpensive yet easily used and highly effective tamper proof package label and closure construction.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is an isometric view of the tamper proof package label and closure construction of the invention prior to utilization for sealing or closing gathered material, such as the neck of a bag or container;

FIG. 2 is an isometric view of the closure construction of FIG. 1 wherein the construction has been fitted about the gathered neck of a container or bag to hold and seal the contents therein;

FIG. 3 is an isometric view of the construction of FIG. 2 wherein the bag closure section has been removed from the bag or container and the label section has been placed on the bag or container as a temporary closure device; and FIG. 4 is an isometric view of alternative closure construction.

DESCRIPTION OF THE PREFERRED EMBODIMENT

Referring to the figures, the tamper proof package label and closure construction comprises a flat plastic plate member divided generally into two sections or parts. A first bag closure section 10 has a generally rectangular or elongate shape including a free end 12 and an opposite end defining an intermediate boundary or junction 14 spaced from the free end 12. The closure construction further includes an integral label section 16 which is also generally rectangular having one side at least, in part, defined by the boundary or seam 14 with closure section 10, and having an opposite side or margin 18 with a V-shaped notch 20 therein. A seam or slit 22 connects from notch 20 to a passage or opening 24 defined in the label section 16. The label section 16 further includes connecting sides 26 and 28.

Referring again to the bag closure section 10, there is provided a fragible seam 30 generally parallel to and intermediate the free end 12 and the boundary or seam 14. The fragible seam 30 may be made by providing a thinner section in the bag closure section 10 or by means of perforation or other means. The seam 30 is shown generally parallel to the free end 12 and connecting or intermediate boundary seam 14. However, the seam 30 may have a pattern, for example, a sinusoidal pattern, or some other curved or serrated pattern. Likewise, the boundary seam 14, or intermediate boundary 14, is preferably a smooth, straight boundary between the closure section 10 and the label section 16. Additionally, the intermediate boundary 14 may be defined by perforations or other means similar to the seam 30. However, the shape of the intermediate boundary 14 and seam 30 should not be considered a limiting feature of the invention. That is, it may be angular, curved, or the like.

The closure construction is typically manufactured from a plastic material, for example, a polyvinyl chloride material. The closure construction may be impregnated with various materials to facilitate sanitation, for example biocides or other similar materials. Additionally, odors, flavors or other materials may be impregnated into the closure construction. Also, importantly, the label section 16 of the closure construction typically will include indicia providing information for the shopper, or those who will observe the tag, attached to a package. For example, as depicted in FIG. 3, bar code indicia 40 may be provided. A color code 42 may be provided. Label information 44 printed on one or both sides of the label section 16 may be provided. The entire tag or closure construction may be formed in a single color which correlates with information associated with the product, for example, the month when the product use expires, the day when the product was manufactured, or the day of the week when the product should be removed from a shelf display. In any event, the label section 16 may include the color integrally incorporated therein by holding or fashioning the closure construction from a certain colored plastic material.

The bag closure section 10 of the closure construction is tightly wrapped about gathered casing or bag material 50 depicted in FIG. 2. The free end 12 is thus folded over and fitted against the closure section 10, and the portion of the closure section 10 adjacent the free end 12 is sealed tightly to the closure section 10. In this manner, the closure section 10 tightly fits around and holds the gathered bag 50 in a sealed condition. Closure and sealing of section 10 may be effected by means of ultrasonic welding, adhesive, melt processing, or other means for attaching the free end 12 and region adjacent thereto to the closure section 10. It should be noted that the seam 30, which is intermediate to the free end 12 and intermediate boundary 14, may be fractured in order to remove the sealed closure section 10 from the package material 50. Fracture of the seam 30 such as depicted in FIG. 3 enables removal of the closure construction. Such fracture also provides the tamper proof characteristic of the closure. That is, if the seam 30 is fractured, then an individual inspecting a package sealed by section 10 will realize that the closure construction has been opened and that the contents of the bag may have been compromised.

The closure construction further includes a tear-away or fragible intermediate boundary 14 which enables separation of the closure section 10 from the label section 16 as depicted in FIG. 3. The label section 16 may then be utilized to temporarily close the gathered end 50 of a package by inserting the gathered end 50 through the notch 20, the slit 22 and into the passage or opening 24. Because the closure construction is manufactured from a generally, flexible plastic material, such use may be effected.

The positioning of the passage 24, notch 20 and the slit 22, as well as the shape and configuration thereof, may be varied to accommodate various types of packaging material and the ease of use of the label section 16. Typically, the closure section 10 will be disposed once the package is opened by tearing along the intermediate boundary 14. However, the user of the construction need not tear away the closure section 10 but may wish to retain it for later disposal with the label section 18.

The shape of each of the sections 10 and 18 may be varied to accommodate various needs and desires of the users of such closures. For example, the label section 18 may have a circular shape, or polygonal shape other than the rectangular shape depicted. Similarly, the dimensions of the closure section 10 may be varied widely to accommodate various types of packaging. Label sections may have a wider girth or a side-to-side dimension, for example, for larger packages. Consequently, the construction may be significantly varied without departing from the scope of the invention. Essential features of the invention comprise the closure section, a label section, and appropriate materials to permit folding of the closure section and thus flexibility and joinder thereof. The flexibility function of the label section is also desired in order to enable use thereof as a temporary closure device.

FIG. 4 depicts some additional alternative features of the invention. Thus, a label section 70 may include a handle member 72 formed integrally for hand carrying. Also, label section 70 may include a passage 74 to permit the tag and thus the associated bag and product to be hung on a hook 76. Thus, the invention may be used by a pharmacy, for example, to package prescriptions and retained at the pharmacy site on hook 76 by hanging passage 74. Thereafter, the customer can open the package and resend as necessary with the closure opening 80.

Other variations in labeling and openings are within the scope of the invention. The invention, therefore, is to be limited only by the following claims and equivalents thereof.

What is claimed is:

1. A tamper proof package label and closure construction comprising, in combination:

a generally flat planar, plastic plate member, said plate member including a bag closure section and a separate, connected label section, said sections being formed from a single sheet of plastic material, said closure section comprising an elongate tab extending from a free end to an intermediate boundary where said closure section is joined to the label section, said closure section being plastically deformable for folding thereof around and closure of gathered packaging material by folded over joinder of the closure section; and said separate label section comprising an extension from the closure section, said intermediate boundary comprising a separable seam for separating the label section from the closure section, said label section including a peripheral margin, and a slit in the margin connected to an opening in the label section to thereby define a means for gathering and retaining gathered packaging material.

2. A tamper proof package label and closure construction comprising, in combination:

a generally flat planar, plastic plate member, said plate member including a bag closure section and a separate connected label section, said closure section comprising an elongate tab extending from a free end to an intermediate boundary wherein said closure section is joined to the label section, said closure section being plastically deformable for folding thereof around and closure of gathered packaging material by folded over joinder of the closure section, said label section comprising an extension from the closure section, said intermediate boundary separating the sections, said label section including a peripheral margin with a slot connected to an opening in the label section to provide a means for gathering and retaining gathered packaging material; said closure section further including a seam intermediate the free end and the intermediate boundary for separating the closure section to effect removal thereof from gathered packaging material.

3. A tamper proof package label and closure construction comprising, in combination:

a generally flat planar, plastic plate member, said plate member including a bag closure section and a separate connected label section, said closure section comprising an elongate tab extending from a free end to an intermediate boundary wherein said closure section is joined to the label section, said closure section being plastically deformable for folding thereof around and closure of gathered packaging material by folded over joinder of the closure section, said label section comprising an extension from the closure section, said intermediate boundary separating the sections, said label section including a peripheral margin with a slot connected to an opening in the label section to provide a means for gathering and retaining gathered packaging material; said construction further including an adhesive for joining the closure section upon folded over joinder.

4. The closure construction of claim 1, 2 or 3 wherein the planar plate member includes, at least in part, informational indicia.

5. The closure construction of claim 4 wherein the informational indicia is selected from the group consisting of color print, bar code, combinations of color print, combinations of color print and barcode, numeric labels, letter labels and combinations thereof.

6. The closure construction of claim 2, or 3 wherein the closure section and label section are each generally rectangular and formed together from a single sheet of plastic material and said intermediate boundary comprises a separable seam for separating the label section from the closure section whereby the label section comprises a separate closure member.

7. The closure construction of claim 1, or 3 wherein the closure section includes a second seam intermediate the free end and intermediate boundary for separating the closure section to effect removal thereof from gathered packaging material.

8. The closure construction of claim 1, 2, or 3 wherein the sections are comprised of a flexible plastic material.

9. The closure construction of claim 1, or 2 wherein the closure section further includes an adhesive for joining the closure section upon folded over joinder.

10. The closure construction of claim 1, or 2 wherein the closure section is susceptible to melt joinder.

11. The closure construction of claim 10 wherein the closure section is susceptible to melt joinder by ultrasonic welding techniques.

12. The construction of claim 1, 2, or 3 wherein the sections are each generally rectangular.

13. A tamper proof package label and closure construction comprising, in combination:

a generally flat planar plastic plate member, said plate member including a bag closure section and a separate, connected integral label section, said closure section comprising an elongate tab extending from a free end to an intermediate boundary where said closure section is joined to the label section, said closure section plastically deformable for folding thereof around and closure of gathered packaging material by folded over joinder of the closure section; and said separate label section comprising an extension from the closure section whereby the intermediate boundary separates the label section from the closure section, said label section including a peripheral margin, said label section also including an opening and a slit connected to the opening from the margin to define a means for gathering and retaining gathered packaging material, said closure section and label section each being generally rectangular and formed together from a single sheet of plastic material and said intermediate boundary comprising a separable seam for separating the label section from the closure section whereby said label section comprises a separate closure member.

14. A tamper proof package label and closure construction comprising, in combination:

a generally flat planar plastic plate member, said plate member including a bag closure section and a separate, connected integral label section, said closure section comprising an elongate tab extending from a free end to an intermediate boundary where said closure section is joined to the label section, said closure section plastically deformable for folding thereof around and closure of gathered packaging material by folded over joinder of the closure section; and said separate label section comprising an extension from the closure section whereby the intermediate boundary separates the label section from the closure section, said label section including a peripheral margin, said label section also including an opening and a slit connected to the opening from the margin to define a means for gathering and retaining gathered packaging material, said closure section including a seam intermediate the free end and intermediate boundary for separating the closure section to effect removal thereof from gathered packaging material.

15. A tamper proof package label and closure construction comprising, in combination:

a generally flat planar plastic plate member, said plate member including a bag closure section and a separate, connected integral label section, said closure section comprising an elongate tab extending from a free end to an intermediate boundary where said closure section is joined to the label section, said closure section plastically deformable for folding thereof around and closure of gathered packaging material by folded over joinder of the closure section; and said separate label section comprising an extension from the closure section whereby the intermediate boundary separates the label section from the closure section, said label section including a peripheral margin, said label section also including an opening and a slit connected to the opening from the margin to define a means for gathering and retaining gathered packaging material, said closure section further including an adhesive for joining the closure section upon folded over joinder.

* * * * *